US007575142B2

(12) United States Patent
Liang et al.

(10) Patent No.: US 7,575,142 B2
(45) Date of Patent: Aug. 18, 2009

(54) CLUTCH MECHANISM FOR ELECTRICAL NAIL GUN

(75) Inventors: Chia-Sheng Liang, Taipei Hsien (TW); Chu Hsiang Tseng, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 200 days.

(21) Appl. No.: 11/863,869

(22) Filed: Sep. 28, 2007

(65) Prior Publication Data

US 2009/0032567 A1 Feb. 5, 2009

(30) Foreign Application Priority Data

Aug. 3, 2007 (TW) ..... 96128582 A

(51) Int. Cl.
*B25C 1/06* (2006.01)

(52) U.S. Cl. ..... 227/133; 227/131; 227/132; 227/129

(58) Field of Classification Search ..... 227/133, 227/131, 132, 129
See application file for complete search history.

(56) References Cited

U.S. PATENT DOCUMENTS

| | | | | |
|---|---|---|---|---|
| 3,581,855 | A * | 6/1971 | Taeffner et al. | 192/18 B |
| 4,323,127 | A * | 4/1982 | Cunningham | 173/53 |
| 4,519,535 | A * | 5/1985 | Crutcher | 227/131 |
| 6,109,122 | A * | 8/2000 | Bori et al. | 74/7 E |
| 6,607,111 | B2 | 8/2003 | Garvis et al. | |
| 6,630,760 | B2 * | 10/2003 | Fulton et al. | 310/75 R |
| 6,669,072 | B2 | 12/2003 | Burke et al. | |
| 6,755,336 | B2 * | 6/2004 | Harper et al. | 227/129 |
| 6,796,475 | B2 * | 9/2004 | Adams | 227/2 |
| 7,007,618 | B1 * | 3/2006 | Chiu | 112/275 |
| 7,334,715 | B2 * | 2/2008 | Oda et al. | 227/2 |
| 7,506,788 | B2 * | 3/2009 | Liang et al. | 227/133 |
| 2002/0104869 | A1 * | 8/2002 | Garvis et al. | 227/138 |
| 2003/0102737 | A1 * | 6/2003 | Fulton et al. | 310/75 R |
| 2005/0218177 | A1 | 10/2005 | Berry et al. | |
| 2005/0242154 | A1 * | 11/2005 | Leimbach | 227/131 |
| 2007/0095876 | A1 * | 5/2007 | Oda et al. | 227/131 |
| 2007/0210134 | A1 * | 9/2007 | Oda et al. | 227/131 |
| 2008/0061105 | A1 * | 3/2008 | Zachrisson et al. | 227/131 |

FOREIGN PATENT DOCUMENTS

| | | | |
|---|---|---|---|
| EP | 1582300 | A2 | 10/2005 |
| WO | 2005097428 | A2 | 10/2005 |

* cited by examiner

*Primary Examiner*—Brian D Nash

(57) ABSTRACT

A clutch mechanism arranged in a housing of an electrical nail gun includes a sliding base, a driver driven by electricity, a swing base pivotally mounted on the housing, and an electric driver attached to the housing and being adjacent to an end side of the swing base. The sliding base is slidably disposed on an end of a free roller positioned in the housing, and the sliding base loads a spring and forms a hitting nail bar thereon. The driver has a motor and a flywheel driven by the motor, and the flywheel is configured to engage or disengage with/from the sliding base. The swing base is adjacent to the sliding base and the free roller and receives the driver therein. The electric driver has a rod member driven by electricity, and the rod member drives the swing base to swing to a first position where the flywheel meshes with the sliding base to thereby drive the sliding base to move downwards, and a second position where the flywheel disengages from the sliding base to thereby cause the sliding base to reposit. Thus, it is an advantage to improve service life and stability of the electrical nail gun.

17 Claims, 14 Drawing Sheets

CLUTCH MECHANISM FOR ELECTRICAL NAIL GUN

BACKGROUND OF THE INVENTION

1. Field of the Invention

The present invention relates to a swing-type clutch mechanism for an electrical nail gun, and more particularly to a clutch mechanism by which kinetic energy can be transmitted among a free roller, a sliding base and a flywheel.

2. Description of Related Art

An electrical nail gun is a type of tool used to hit nails into wood or some other kind of material. Usually, there is a battery pack or an AC electrical power source in a housing of the electrical nail gun to provide electrical power to a motor, thereby rotating the motor. A rotary kinetic energy of the motor is transformed into a linear kinetic energy by a transmission mechanism to drive a hitting nail bar to hit nails.

Among a more advanced technology, many US patents, such as U.S. Pat. No. 6,607,111 and U.S. Pat. No. 6,669,072 and so on, teach a flywheel driven by a DC motor, a clutch assembly being capable of linear movement by traction of a wire disposed on an axis of a solenoid. The clutch assembly has a wire drum and connects to a driving base via at least a wire. When a nail gun is driven by a user, the clutch assembly is moved along an axis direction to mesh with a flywheel which is rotating, thereby rotating the clutch assembly. Therefore, a rotary kinetic energy is transformed into a linear kinetic energy of the hitting nail bar to then impact nails via traction of the wire. However, the structure of the clutch assembly is complicated due to too many components, and it is a disadvantage to improve service life of the nail gun because the driving base is pulled by a rope to move downwardly to hit nails.

In addition, a number of patents, such as U.S.P 20050218177, WO No. 2005097428, and EP No. 1582300 and so on, teach a driver produced by a solenoid. The driver linearly pushes a swing arm forming a roller to swing. A driving base of a hitting nail bar is pushed by the roller to urge the driving base to mesh with a rotating flywheel. Thus, a rotary kinetic energy of the flywheel is transformed into a linear kinetic energy of a hitting nail bar to impact a nail. Wherein, the roller, the driving base, and the flywheel cooperatively form a clutch assembly being capable of engagement or disengagement. However, during a long-term use, an abrasion may be produced by friction between the roller, the driving base, and the flywheel to thereby broaden mesh clearance. When the driving base of the hitting nail bar is pushed by the roller towards the flywheel to mesh with the flywheel, a component acting force is produced not along a direction of impacting the nail due to clearance, thereby affecting safety and stability as the driving base is driving the hitting nail bar to impact the nail. Accordingly, the above-mentioned problems need to be further improved.

SUMMARY OF THE INVENTION

What is needed, therefore, is to provide a rotational kinetic energy clutch mechanism for an electrical nail gun, which by not using a wire to transmit the hitting force overcomes the problems of reduced lifetime of the nail gun and generating a component force misaligned with a desired nail hitting direction after long-term use.

An object and effect of the present invention is carried out through the following technology means. The clutch mechanism arranged in a housing of an electrical nail gun includes:

a sliding base slidably disposed on an end of a free roller positioned in the housing, the sliding base loading a spring and forming a hitting nail bar thereon;

a driver driven by electricity, the driver having a motor and a flywheel driven by the motor, the flywheel being configured to engage or disengage with/from the sliding base;

a swing base pivotally mounted on the housing, the swing base being adjacent to the sliding base and the free roller and receiving the driver therein; and an electric driver attached to the housing and being adjacent to an end side of the swing base, the electric driver having a rod member driven by electricity, wherein the rod member drives the swing base to swing to a first position where the flywheel meshes with the sliding base to thereby drive the sliding base to move downwards, and a second position where the flywheel disengages from the sliding base to thereby cause the sliding base to reposit.

In addition, the present invention further includes at least one extension spring is disposed on the sliding base, the at least one extension spring is connected a positioning post in the housing with the sliding base. In one preferred embodiment, the sliding base is fixedly mounted on a sliding table which is slidably mounted at least one guiding post in the housing, and a compression spring is displaced around the at least one guiding post for resisting against the sliding table to thereby load the compression spring on the sliding base. A side surface of the sliding base defines a plurality of linear grooves therein, and the flywheel defines a plurality of ring-shaped or sector-shaped grooves therein for mesh with the linear grooves of the sliding base. The swing base is rotatably mounted on a post axis in the housing, and the flywheel is adjacent to end sides of the sliding base and the free roller. The flywheel is securely mounted on a central axis of the motor for being driven by the motor. The motor is disposed on a side of the flywheel for driving the flywheel to rotate. In another preferred embodiment, the swing base is formed to have a ring portion thereon for receiving the motor therein, and the flywheel is disposed on the swing base and adjacent to opposite end sides of the sliding base and the free roller. The swing base is formed to have an arm portion thereon. The electric driver is an electromagnetic driver. An extension plate extends out from the swing base, and the rod member pushes the extension plate to thereby drive the swing base to swing from the second position to the first position. An elastic member is disposed between the extension plate and an end wall of the housing for driving the swing base to swing from the first position to the second position, or the rod member is connected to the extension plate for driving the swing base to swing between the first position and the second position.

Based on the above-mentioned, the clutch mechanism in accordance with the present invention improves service life of the electrical nail gun because the flywheel is rotated to directly mesh with the sliding base. Furthermore, the clutch mechanism is unlikely to generate a component force misaligned with a desired nail hitting direction during long-term use of the electrical nail gun, thereby improving the durability of the clutch mechanism for the electrical nail gun in long-termed use of the electrical nail gun.

Other advantages and novel features will be drawn from the following detailed description of preferred embodiment with the attached drawings, in which:

DETAILED DESCRIPTION OF THE INVENTION

Figure 1:
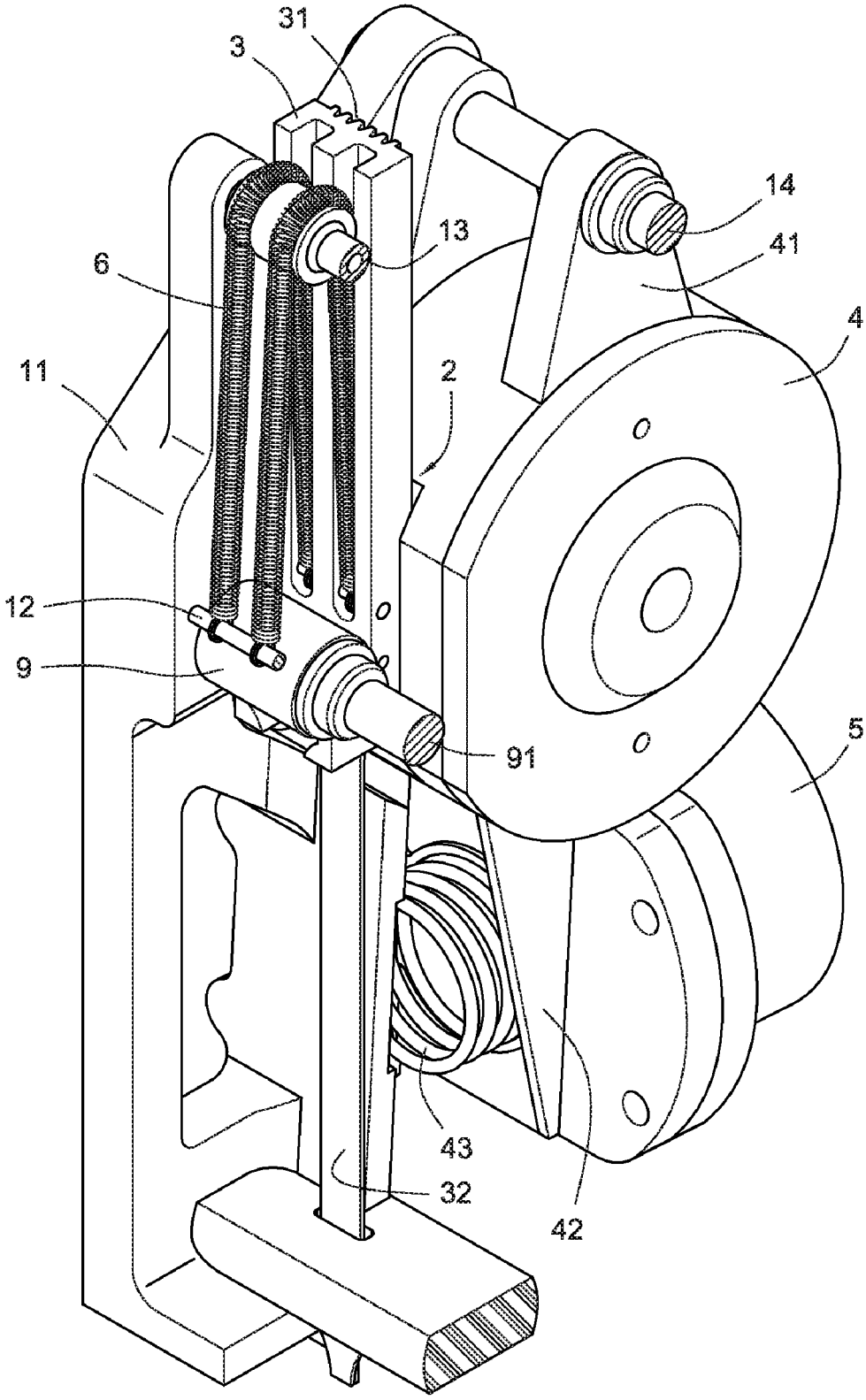
FIG. 1 is a perspective view of a clutch mechanism for transmission of kinetic energy in accordance with a preferred embodiment of the present invention.
Figure 2:
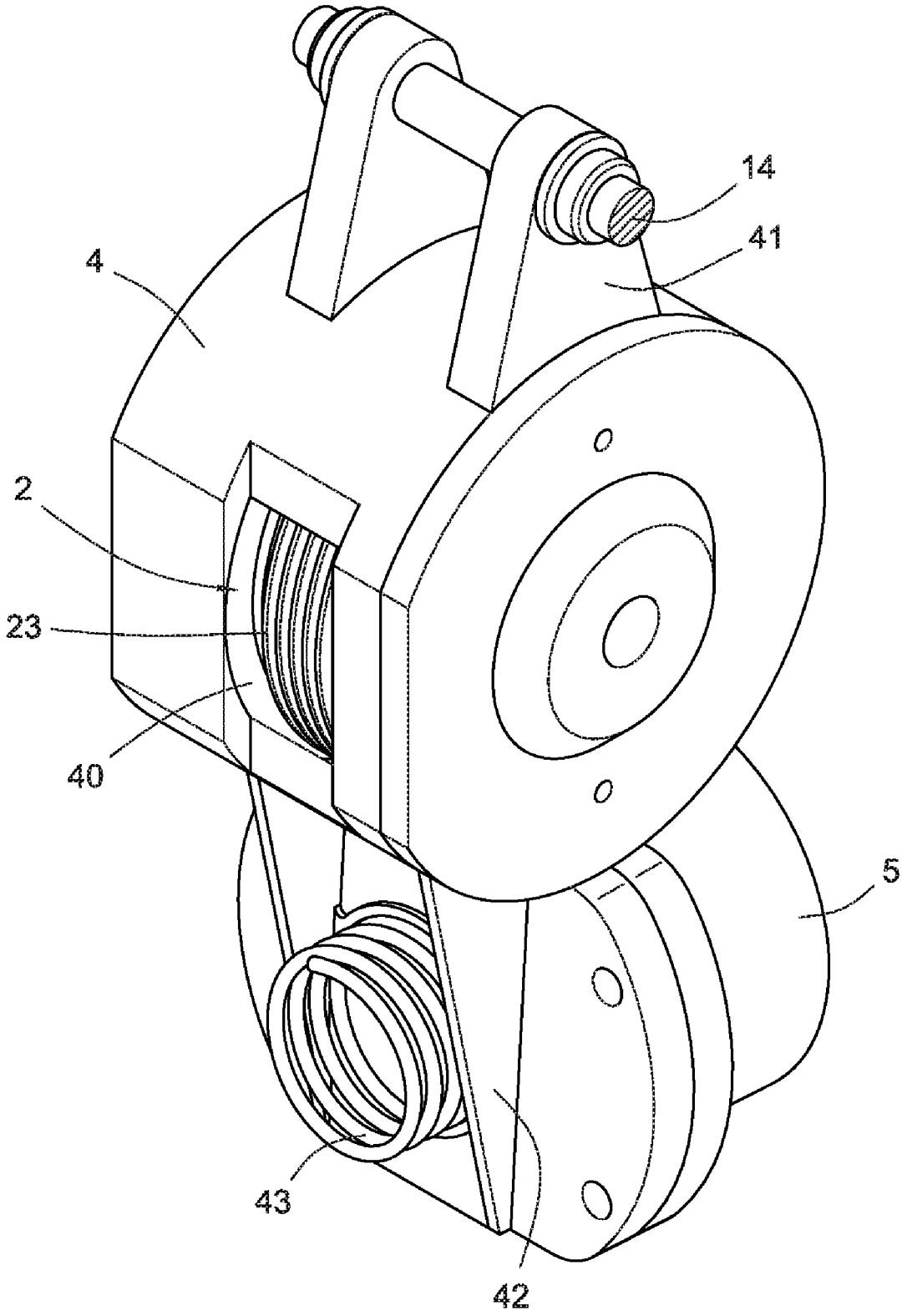
FIG. 2 is a perspective view of a swing base of the clutch mechanism in FIG. 1.
Figure 3:
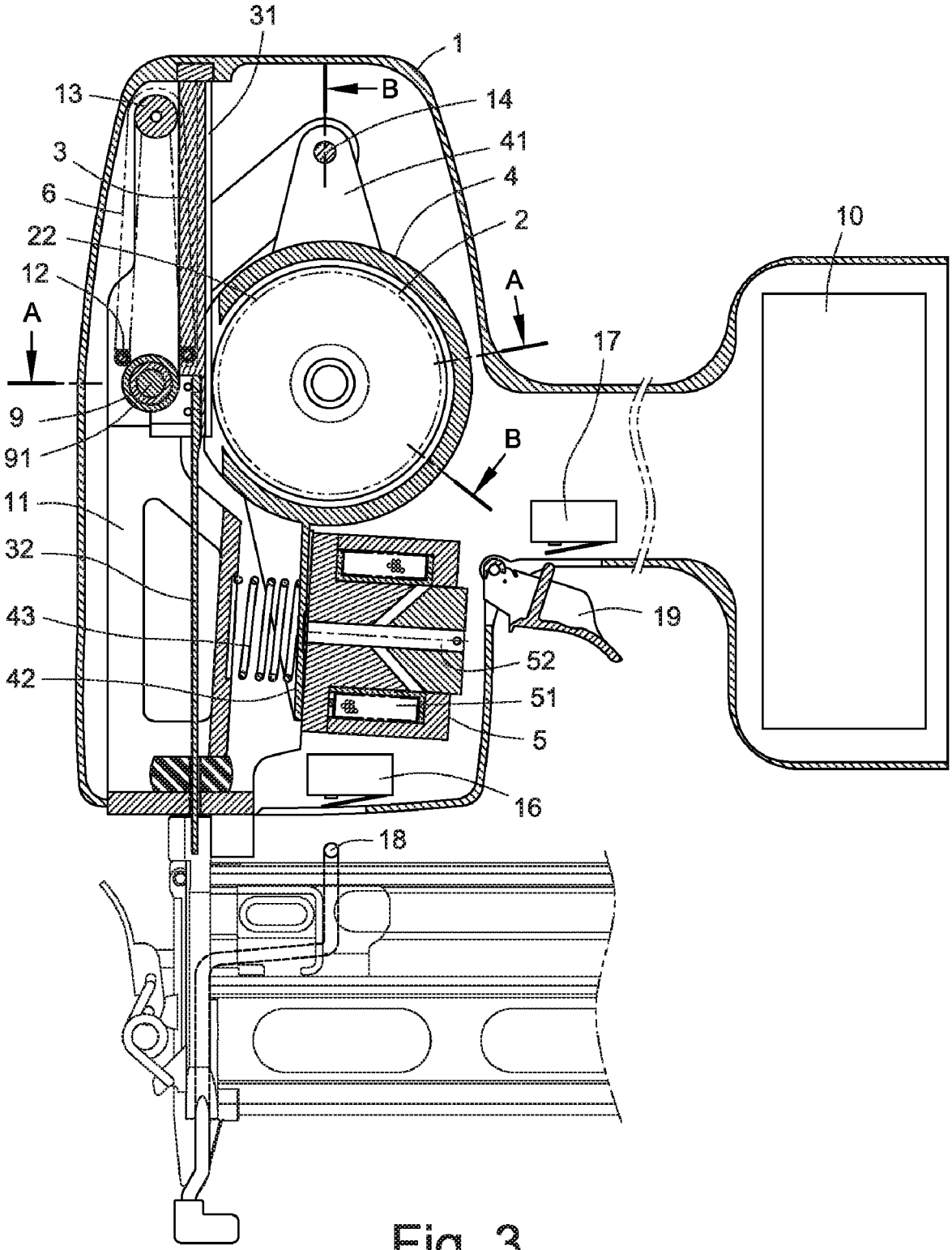
FIG. 3 is a cross sectional view of FIG. 1, shown the clutch mechanism in an electrical nail gun.
Figure 4:
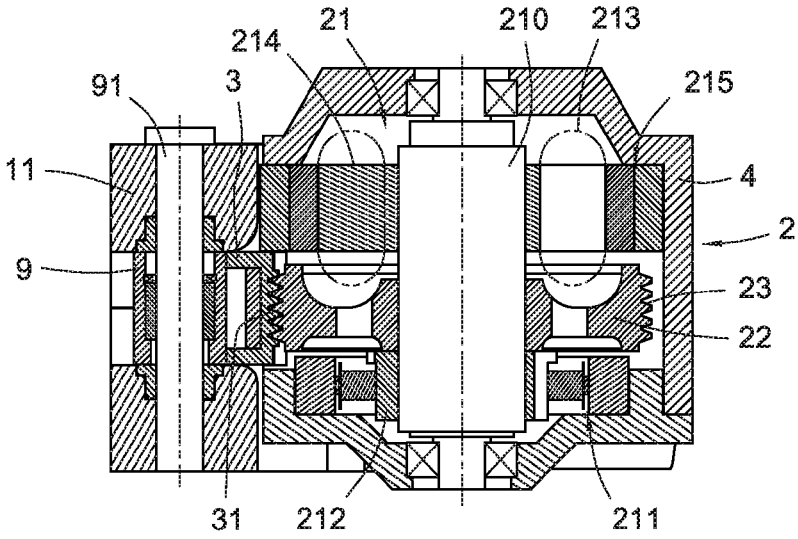
FIG. 4 is a cross sectional view of FIG. 3, taken along a line A-A.
Figure 5:
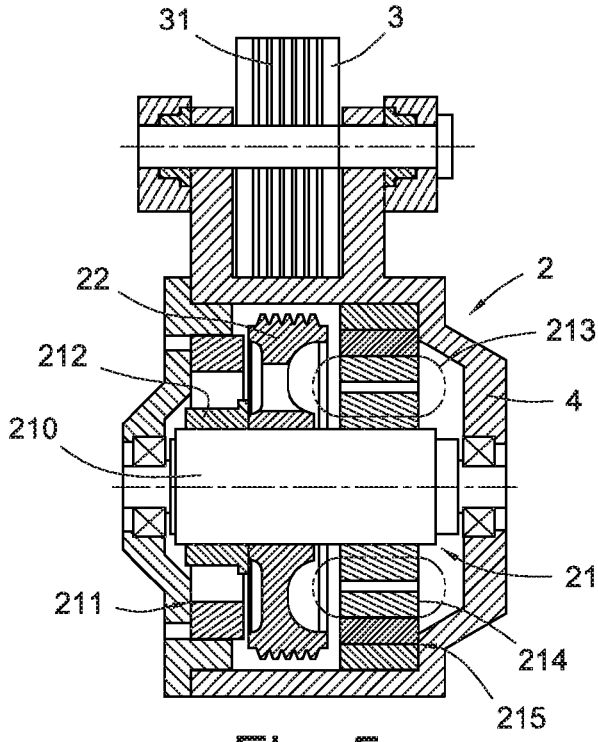
FIG. 5 is a cross sectional view of FIG. 3, taken along a line B-B.

Referring to FIGS. 1 to 5, a clutch mechanism for transmission of kinetic energy in an electrical nail gun in accordance with a preferred embodiment of the present invention is shown. A suitable power source, such as the battery pack 10 for providing direct current, is received in a distal end of a housing 1. A supporting bracket 11 is formed on a head portion of the housing 1, for mounting a sliding base 3, a driver 2, a swing base 4, and an electric driver 5 thereon. A first switch 16 and a second switch 17 are formed on the housing 1. The first switch 16 is arranged on a bottom end of the housing 1 where a safety sliding rod 18 is capable of touching the first switch 16. The second switch 17 is located on an end side of the housing 1 where a trigger 19 mounted on the housing 1 can touch the second switch 17.

The sliding base 3, loading a spring 6, is slidably mounted in the housing 1 and arranged on an end side of a free roller 9. Substantially, at least an extension spring 6 is wrapped around the rolling post 13 to connect a positioning post 12 and the sliding base 3. The extension spring can drive the sliding base 3 to move upwards without an engagement driving force. The free roller 9 is pivotally attached to the supporting bracket 11 via a shaft 91 and pivots about the shaft 91. The sliding base 3 defines a plurality of linear grooves 31 therein. A hitting nail bar 32 is fixedly mounted on a bottom end of the sliding base 3.

The driver 2 includes a motor 21 which is driven by the battery pack 10. The motor 21 may be driven by the battery pack 10 which is controlled by the first switch 16 or the second switch 17. Alternatively, the motor 21 may be driven by other AC (Alternating Current) power supplies via a conductive wire. A rotator assembly 210 is disposed on an axis of the motor 21. The driver 2 includes a flywheel 22 driven by the motor 21. The flywheel 22 defines a plurality of ring-shaped (sector-shaped) grooves 23 therein for mesh with the linear grooves 31 of the sliding base 3. The flywheel 22 is fixedly mounted on the rotator assembly 210 of the motor 21. The motor 21 includes carbon brush assembly 211, a commutator 212, a winding coil 213, a silicon-steel plate armature core 214, a stator 215 and so on, which is wrapped around the rotator assembly 210 and arranged on two sides of the flywheel 22. When the winding coil 213 is activated by electricity, the rotator assembly 210 and flywheel 22 mounted on the rotator assembly 210 are driven to rotate.

The swing base 4 defines a receiving room therein for accommodating the driver 2. A shape of the swing base 4 may be similar to a shape of the motor 21. An opening 40 is defined in an outside wall of the swing base 4 for partial exposure the ring-shaped (or sector-shaped) groove 23 outside the swing base 4. An arm portion 41 is extended from the swing base 4 for rotatably mounting the swing base 4 on a post axis 14 in the housing 1. Thus, the flywheel 22 is adjacent to end sides of the sliding base 3 and the free roller 9.

The electric driver 5 may be substantially a magnetic driver including a rod member 52 driven by a solenoid 51, or the like driven by electricity (for example, a pushing device including a worm which is driven by a motor to thereby causing a reciprocating movement of the worm). The electric driver 5 is securely attached to an end side of the supporting bracket 11. The solenoid 51 is activated or demagnetized via switching on the first switch 16 or the second switch 17. When the solenoid 51 is activated, the swing base 4 is driven to rotate to a first position 81 (as shown in FIG. 6*f*) in which the flywheel 22 can mesh with the sliding base 3 to cause a downward movement of the sliding base 3, and when the solenoid 51 is demagnetized, the swing base 4 is rotated to a second position 82 (as shown in FIG. 6*c*) in which the flywheel 22 disengage from the sliding base 3 to cause an upward movement of the sliding base 3 due to elastic recovery of the extension spring 6.

In greater detail, an extension plate 42, extending out from the swing base 4, is pushed by the rod member 52 of the electric driver 5 which may be connected to the extension plate 42. Thereby, the swing base 4 is driven from the second position 82 to the first position 81. Alternatively, the rod member 52 may drive another portion of the swing base 4 to pivot the swing base 4 about the post axis 14, thereby causing a movement of the swing base 4 from the second position 82 to the first position 81. Furthermore, an elastic member 43 may be arranged between the extension plate 42 and the supporting bracket 11 to push against the swing base 4 to swing from the first position 81 to the second position 82 (as shown in FIG. 6*e*). The elastic member 43 may be substantially a compression extension or the like.

According to the aforementioned structure, two operation modes, such as a sequential actuation mode and a contact actuation mode, are described in detail as follows.

Figure 6:
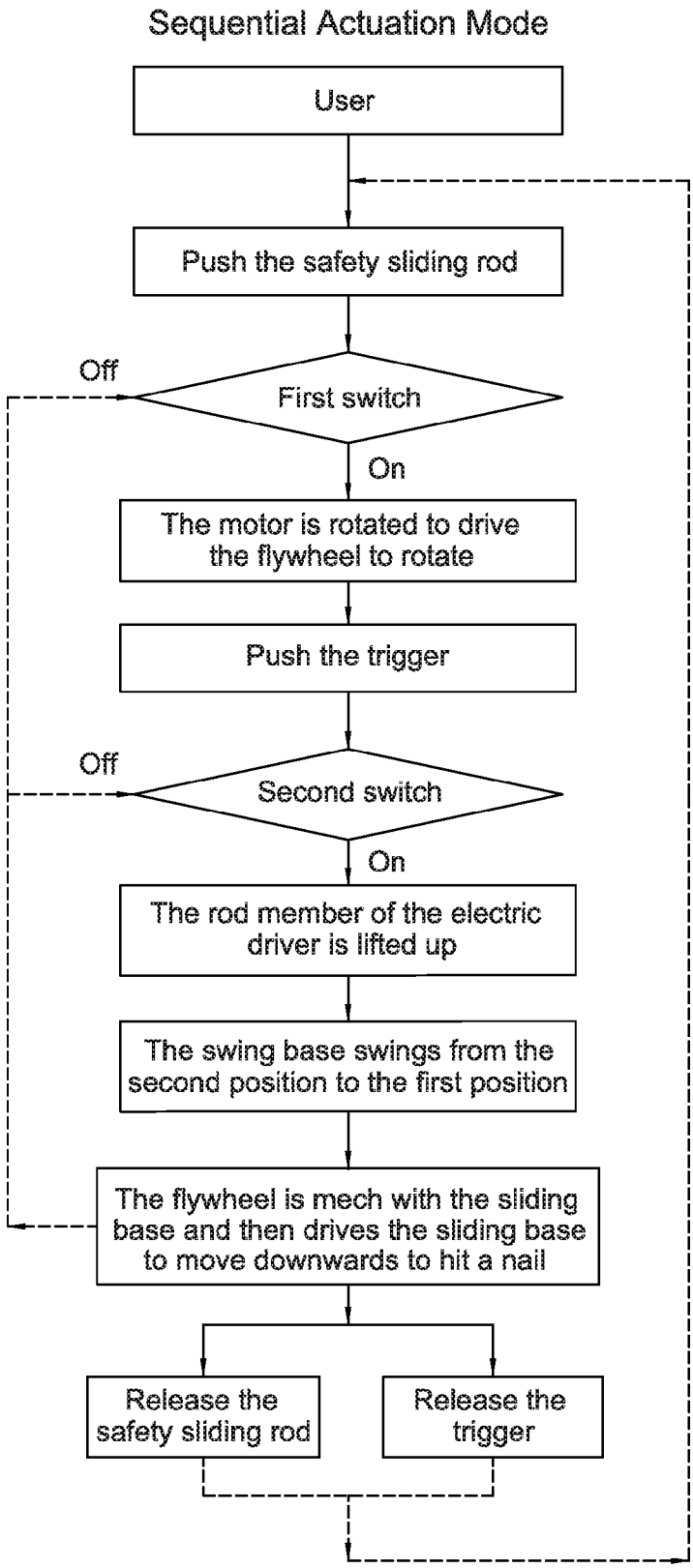
FIG. 6 is a flow diagram of a sequential actuation mode of the preferred embodiment.
Figure 6A:
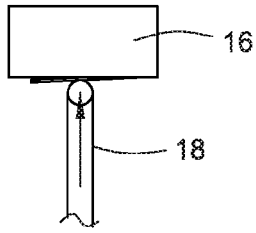
FIG. 6*a* to FIG. 6*g* are a cross sectional view of the preferred embodiment of the present invention, during starting a hitting nail operation.
Figure 6B:
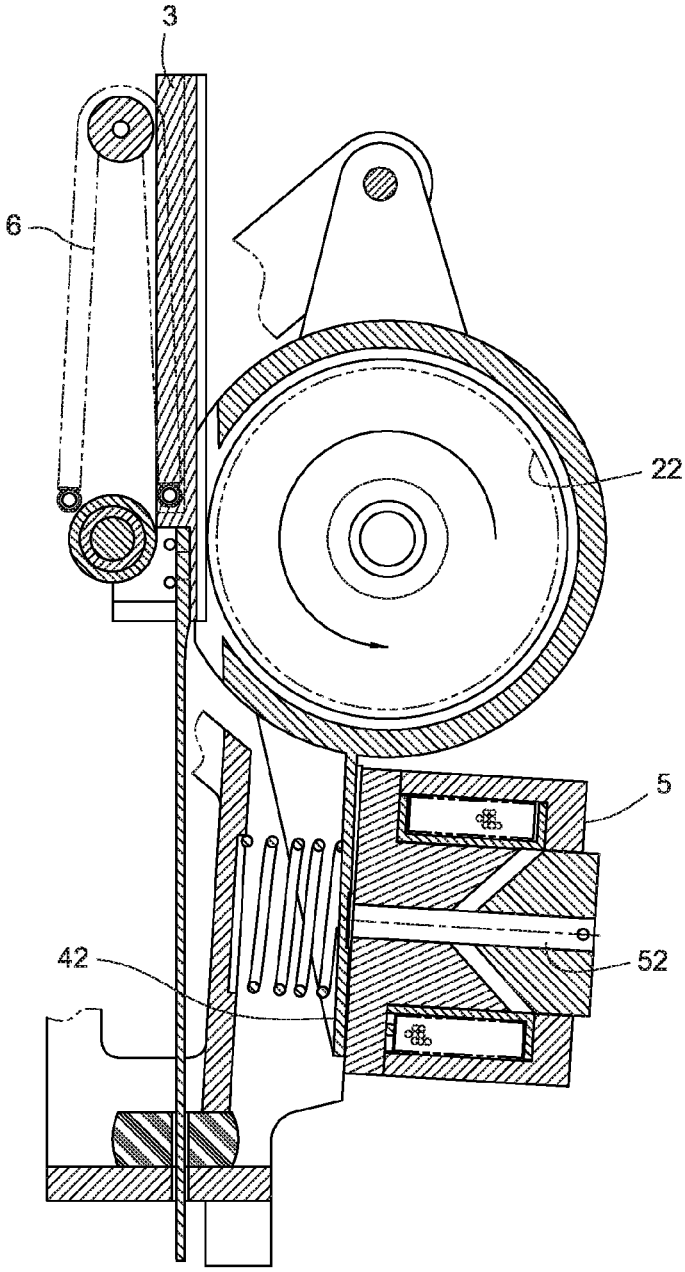
Figure 6C:
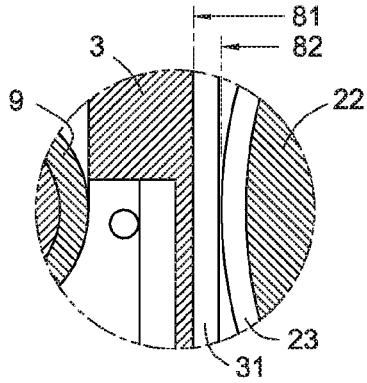
Figure 6D:
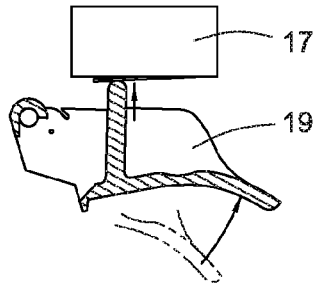
Figure 6E:
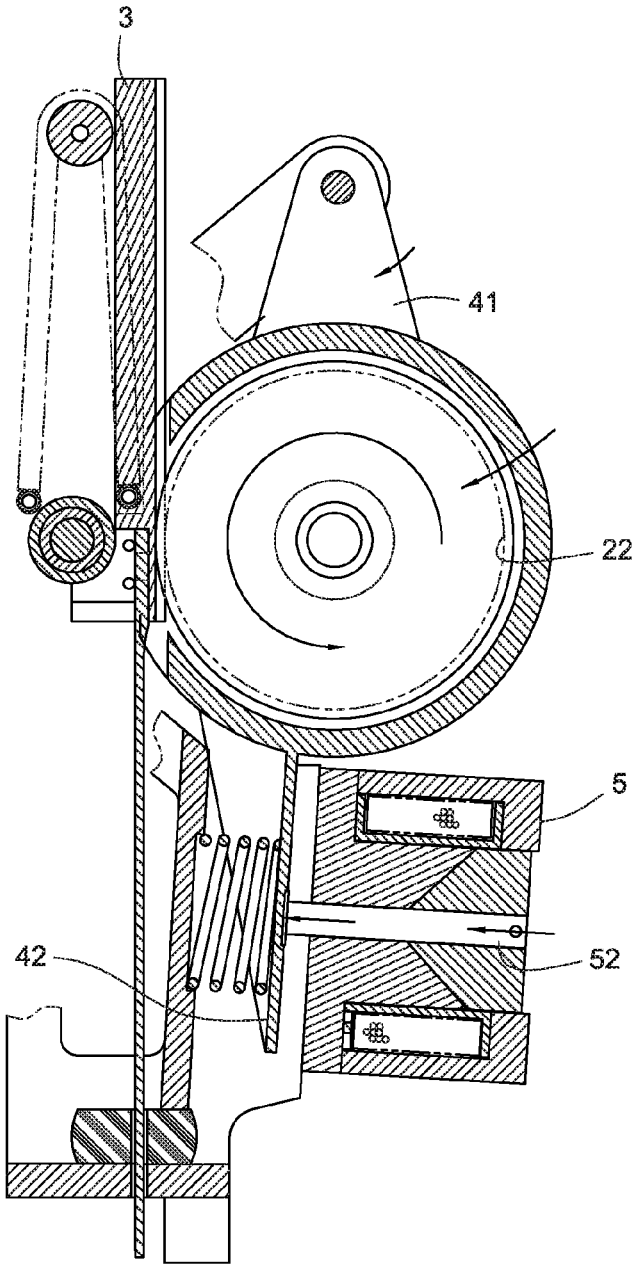
Figure 6F:
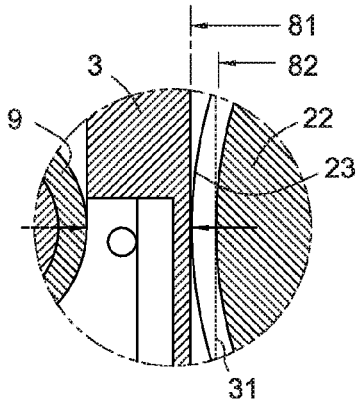
Figure 6G:
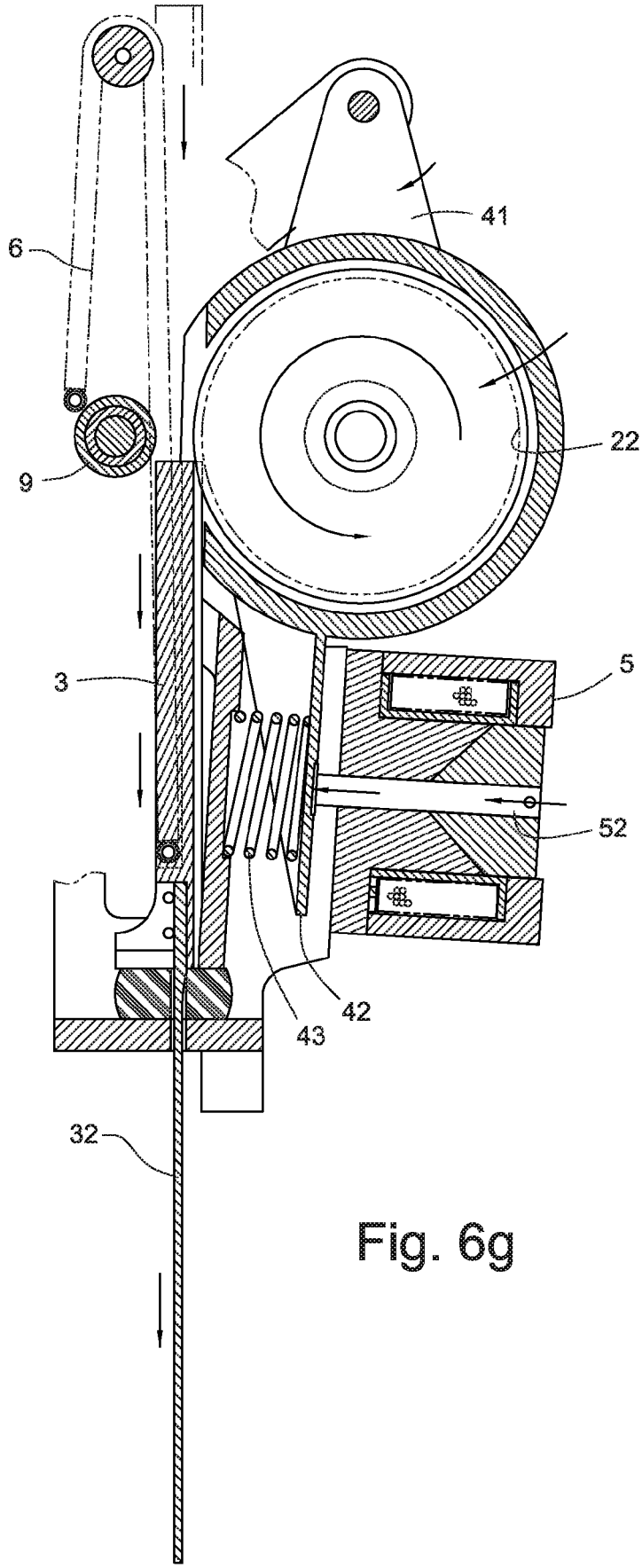

FIG. 6 shows the sequential actuation mode. The safety sliding rod 18 is first pushed against the workpiece by a user. The first switch 16 (shown in FIG. 6*a*) is then switched on to cause the motor 21 to rotate, thereby driving the flywheel 22 to rotate (shown in FIG. 6*b*). At the moment, the flywheel 22 remains in the second position 82 (as shown in FIG. 6*c*) in disengagement with the sliding base 3. Subsequently, the user pulls the trigger 19 to switch on the second switch 17 (as shown in FIG. 6*d*). Thus, the electric driver 5 is activated by the battery pack 10 to cause a traverse extension of the rod member 52, thereby driving the swing base 4 to rotate to the first position (as shown in FIG. 6*f*). When the flywheel 22 exerts a force on the sliding base 3 and stably meshes with the sliding base 3, the sliding base downwardly moves to hit a nail after overcoming the extension spring 6 (shown in FIG. 6*g*). After a hitting nail operation is finished, the first and second switches 16, 17 are automatically switched off so that the motor 21 stops rotating, the solenoid 24 is demagnetized. Accordingly, the swing base 4 is driven by the elastic member 43 or the rod member 52 connected with the extension plate 42 to rotate from the first position 81 to the second position 82, thereby disengaging the flywheel 22 from the sliding base 3. Subsequently, the sliding base 3 returns the original position due to recovery of the extension spring 6. A single sequential actuation is thus finished as the user releases the safety sliding rod 18 and the trigger 19. If a next operation needs to be performed, the user may repeat the above-mentioned sequential actuation. Consequently, it is a safety design for avoiding a mis-operation.

Figure 7:
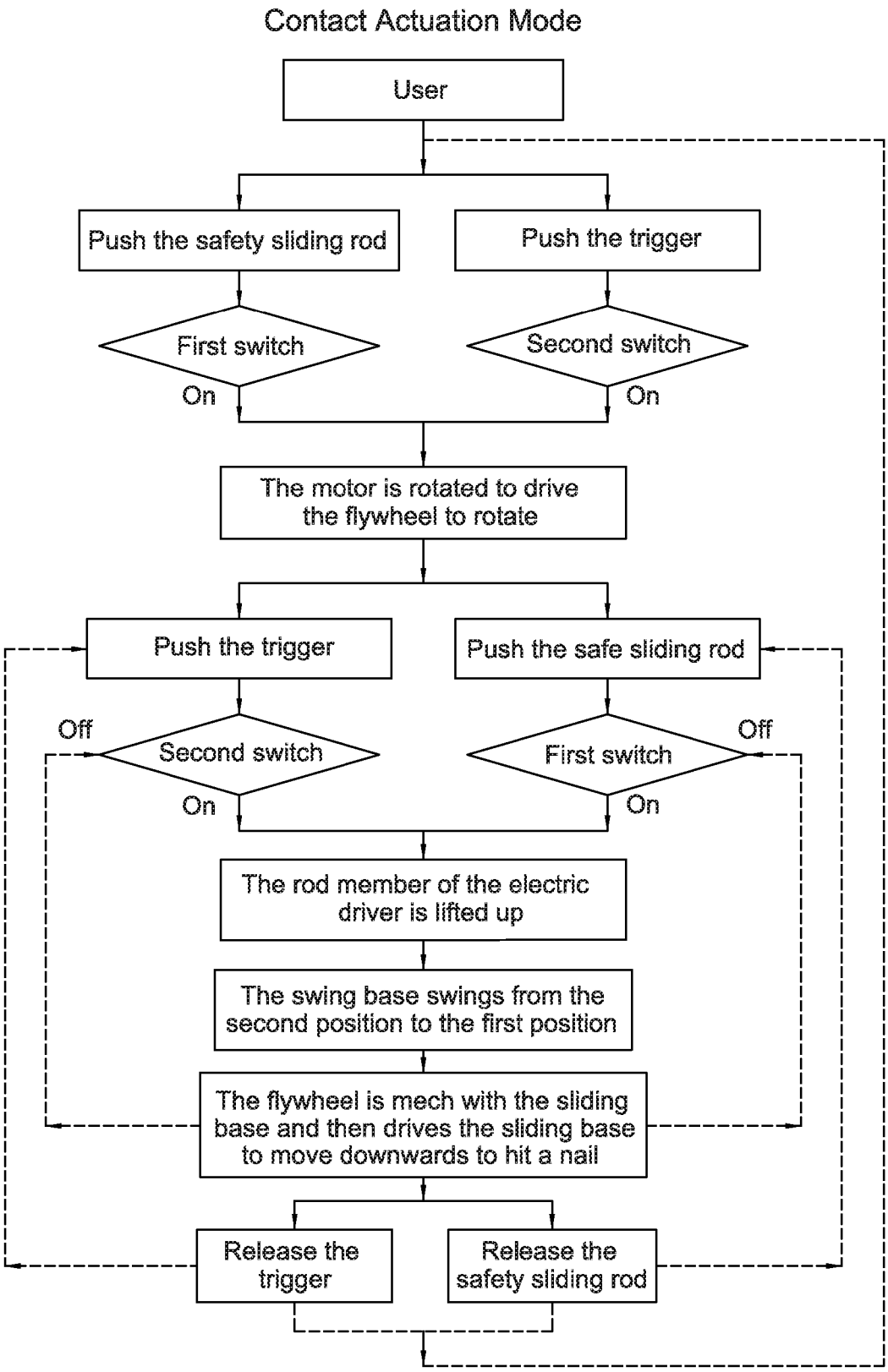
FIG. 7 is a flow diagram of a contact actuation mode of the preferred embodiment of the present invention.

FIG. 7 shows the contact actuation mode. At first, the user may selectively push the safety sliding rod 18 against the workpiece or pull the trigger 19 to switch on the first switch 16 (as shown in FIG. 6*a*) or the second switch 17 (as shown in FIG. 6*d*), thereby rotating the motor 21. Then the motor 21 drives the flywheel 22 to rotate (as shown in FIG. 6*b*). When the safety sliding rod 18 is first pushed against the workpiece by the user to urge the flywheel 22 to rotate. The user pulls the trigger 19 to switch on the second switch 17 to operate the above-mentioned sequential actuation mode. The difference lies in: after a single hitting nail operation is finished, the user may only release the safety sliding rod 18 and not release the trigger 19, or only release the trigger 19 and not release the safety sliding rod 18, if the safety sliding rod 18 is pushed again or the trigger 19 is pulled again, a second hitting nail operation can be thus started. When the user first pulls the trigger 19 to switch on the second switch 17 to cause rotation of the flywheel 22 (as shown in FIGS. 6*d* and 5*b*). Subsequently, the safety sliding rod 18 is pushed by the user to switch on the first switch 16, thereby urging extension of the rod member 52 of the electric driver 5 (as shown in FIG. 6*e*). The transmission of kinetic energy and hitting nail operation is the same to the aforementioned operation. It is a contact actuation mode which is advantageous to a continuous hitting nail operation.

Figure 8A:
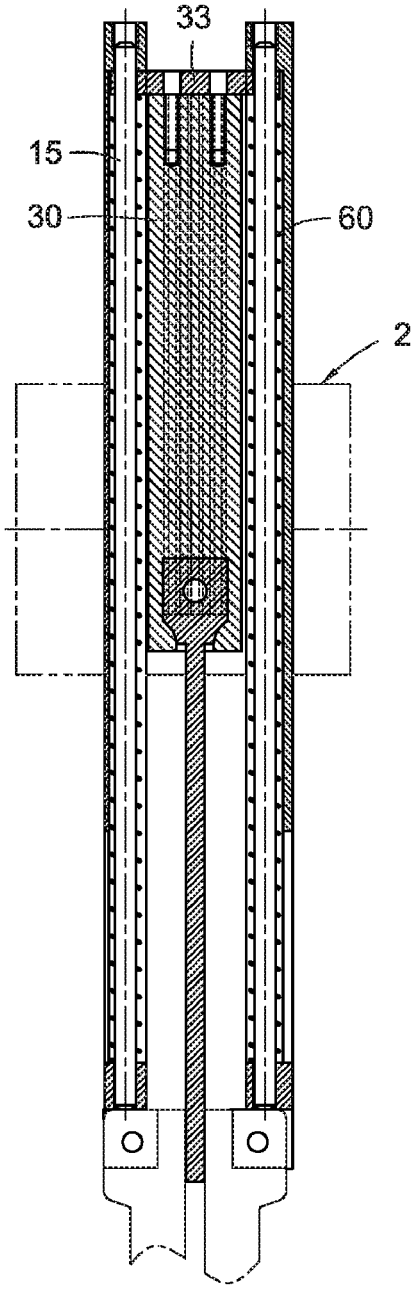
FIG. 8*a* to FIG. 8*b* are a working schematic view of an alternative sliding base.
Figure 8B:
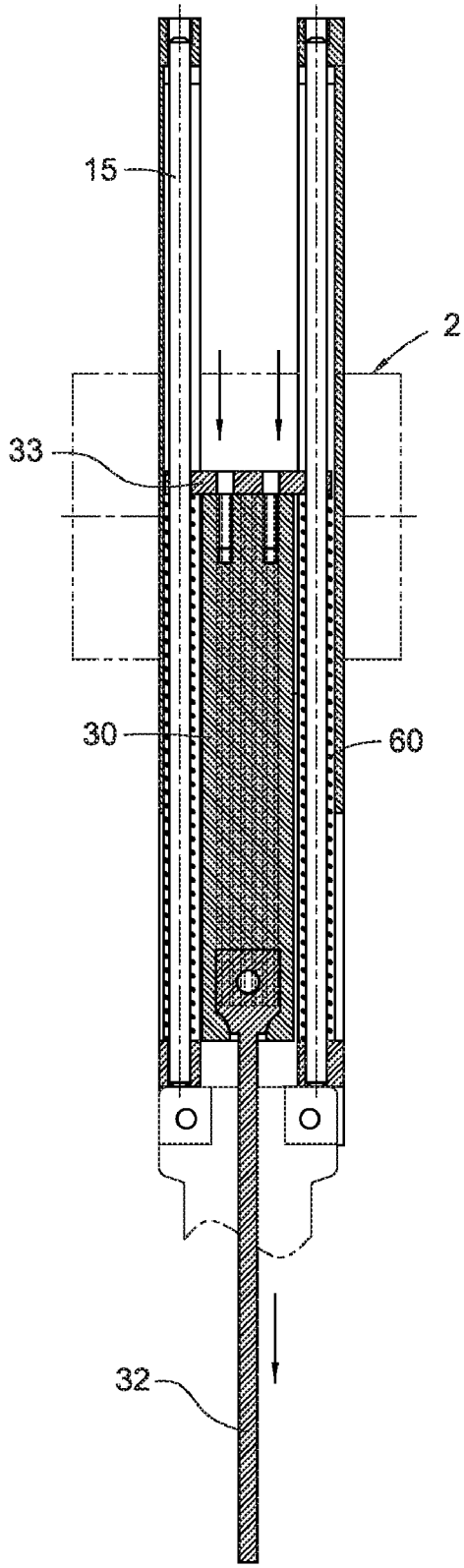

Referring to FIGS. 8*a* and 8*b* show an alternative sliding base 30. The difference from the sliding base 3 lies in: the sliding base 30 is securely mounted on a sliding table 33 which is slidably on at least one guiding post 15 in the housing 1. A compression spring 60 is displaced around the at least one guiding post 15 for resist against the sliding table 33, thereby making the sliding base 30 to load the compression spring 60. Thus, the sliding base 30 remains an upward movement without an acting force or driving of the flywheel 22. Further, when the flywheel 22 drives the sliding base 30 to move downwardly, the sliding table 33 compresses the compression spring 60. Understandably, the compression spring 60 may be replaced by the extension spring 6.

Figure 9:
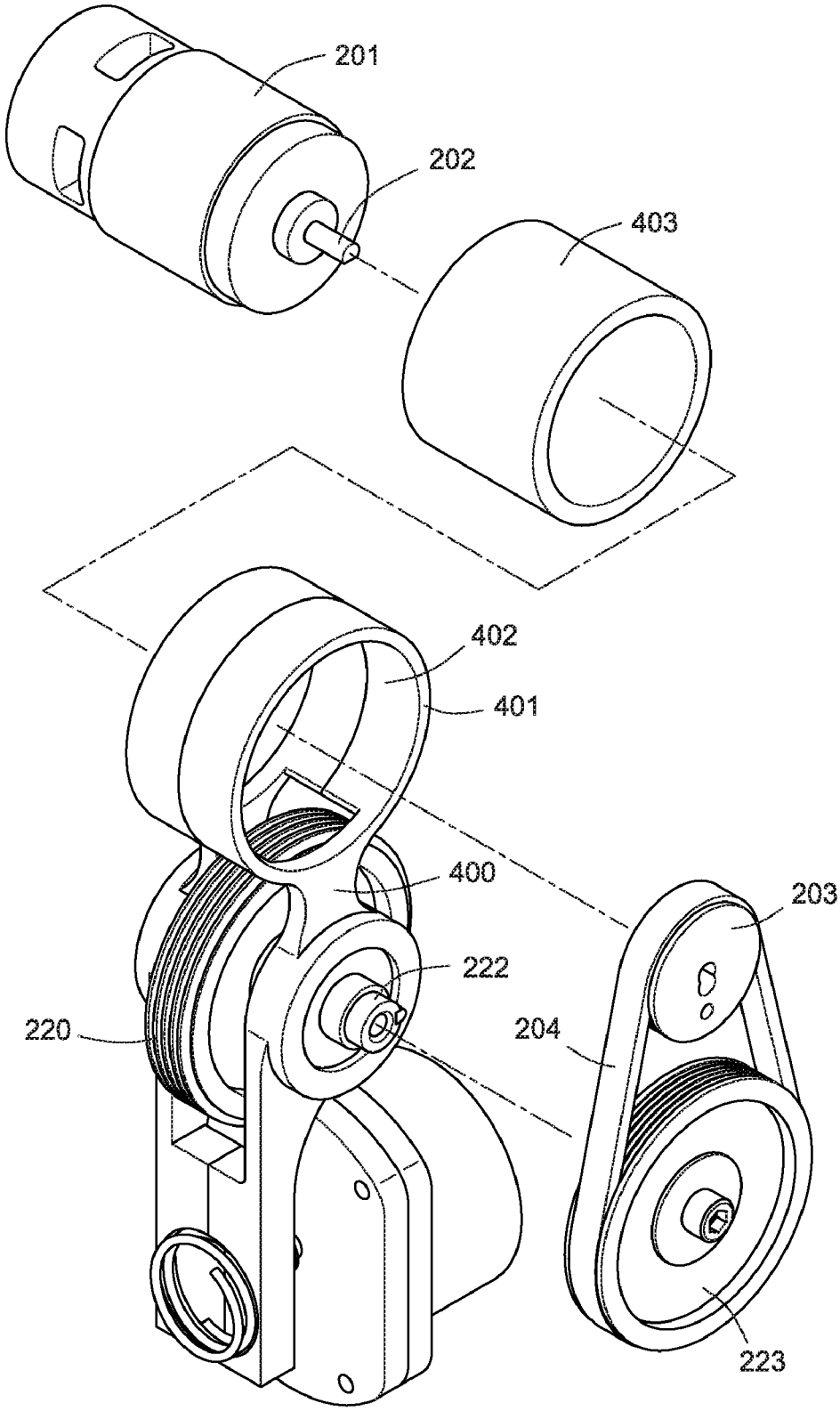
FIG. 9 is an exploded, perspective view of an alternative motor and flywheel.
Figure 10:
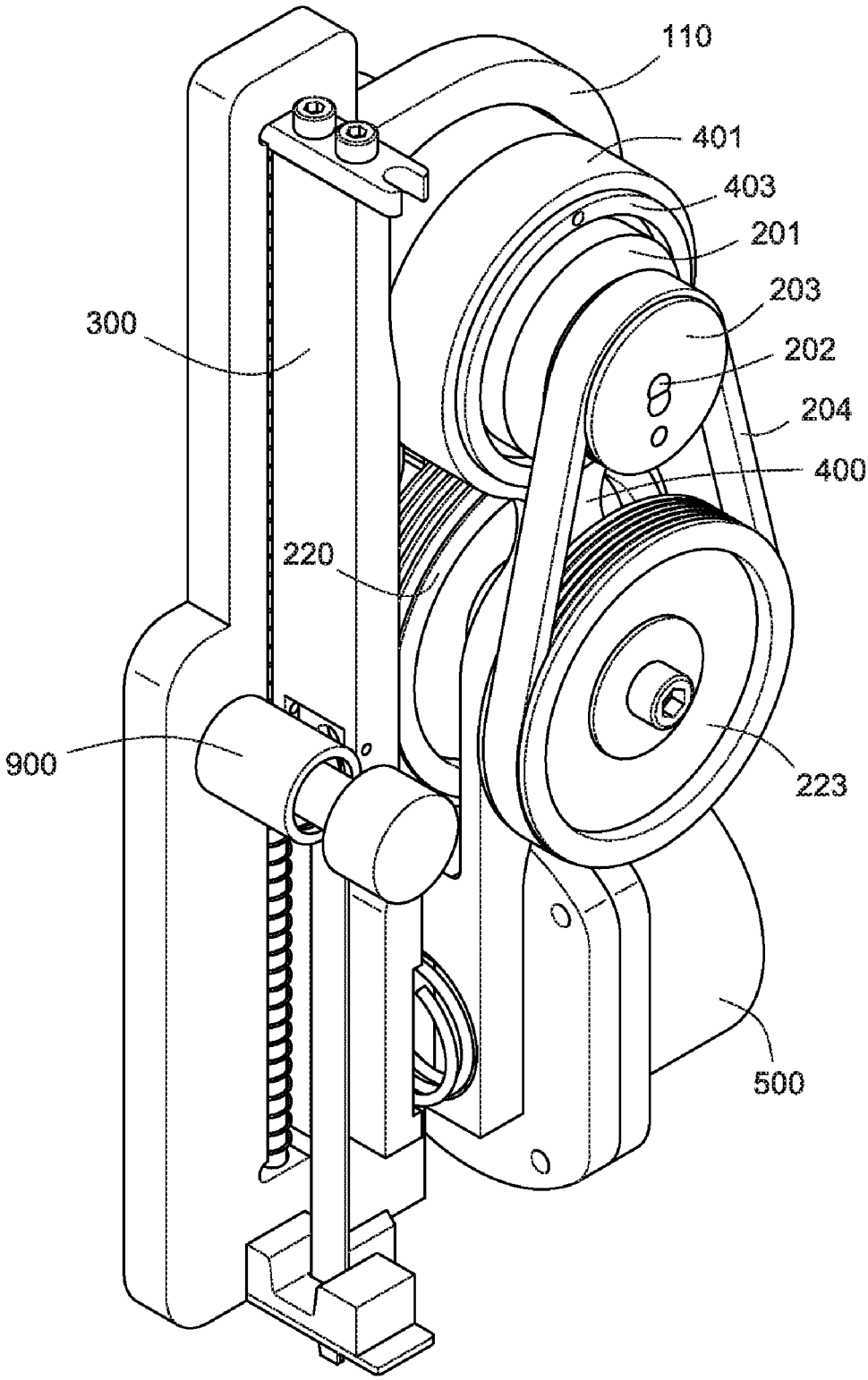
FIG. 10 is an exploded, perspective view of FIG. 9, but the alternative motor and flywheel mounted in a housing of the electrical nail gun.
Figure 11:
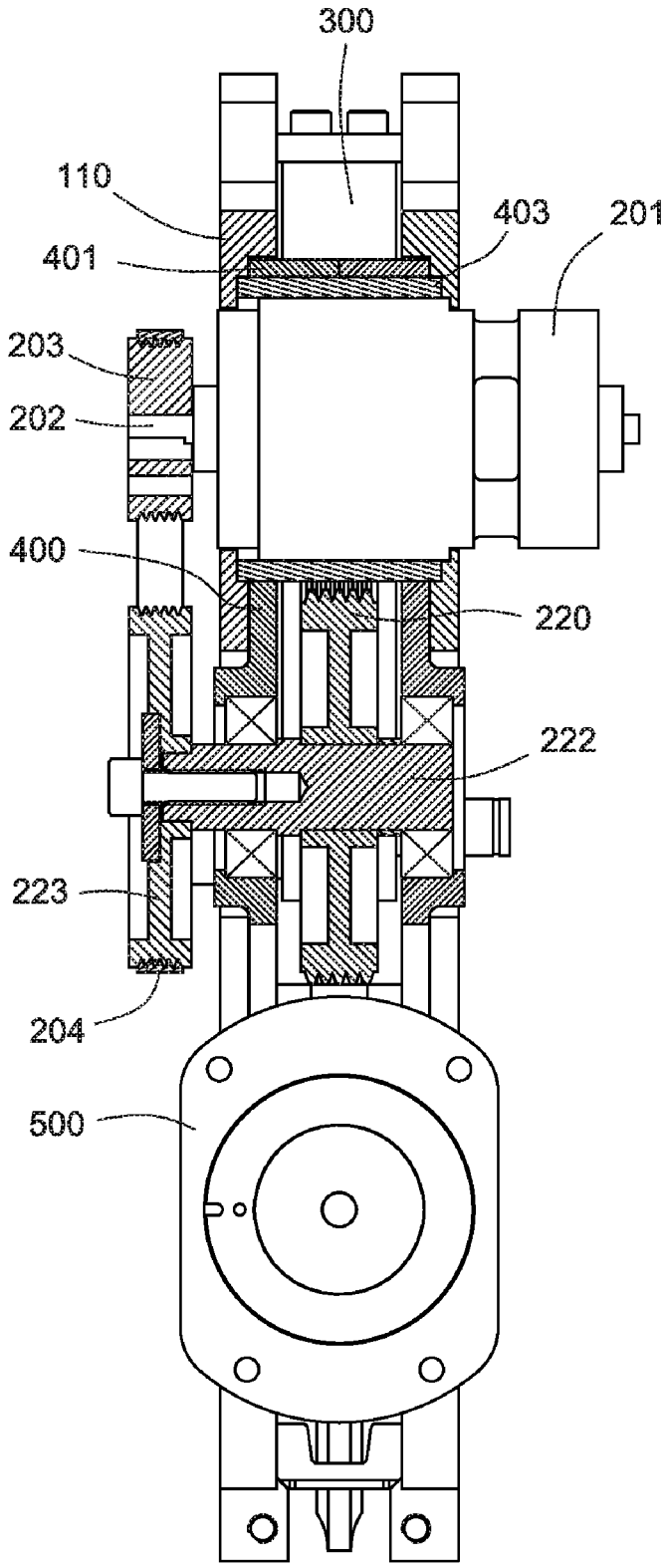
FIG. 11 is a side cross sectional view of FIG. 10.
Figure 12:
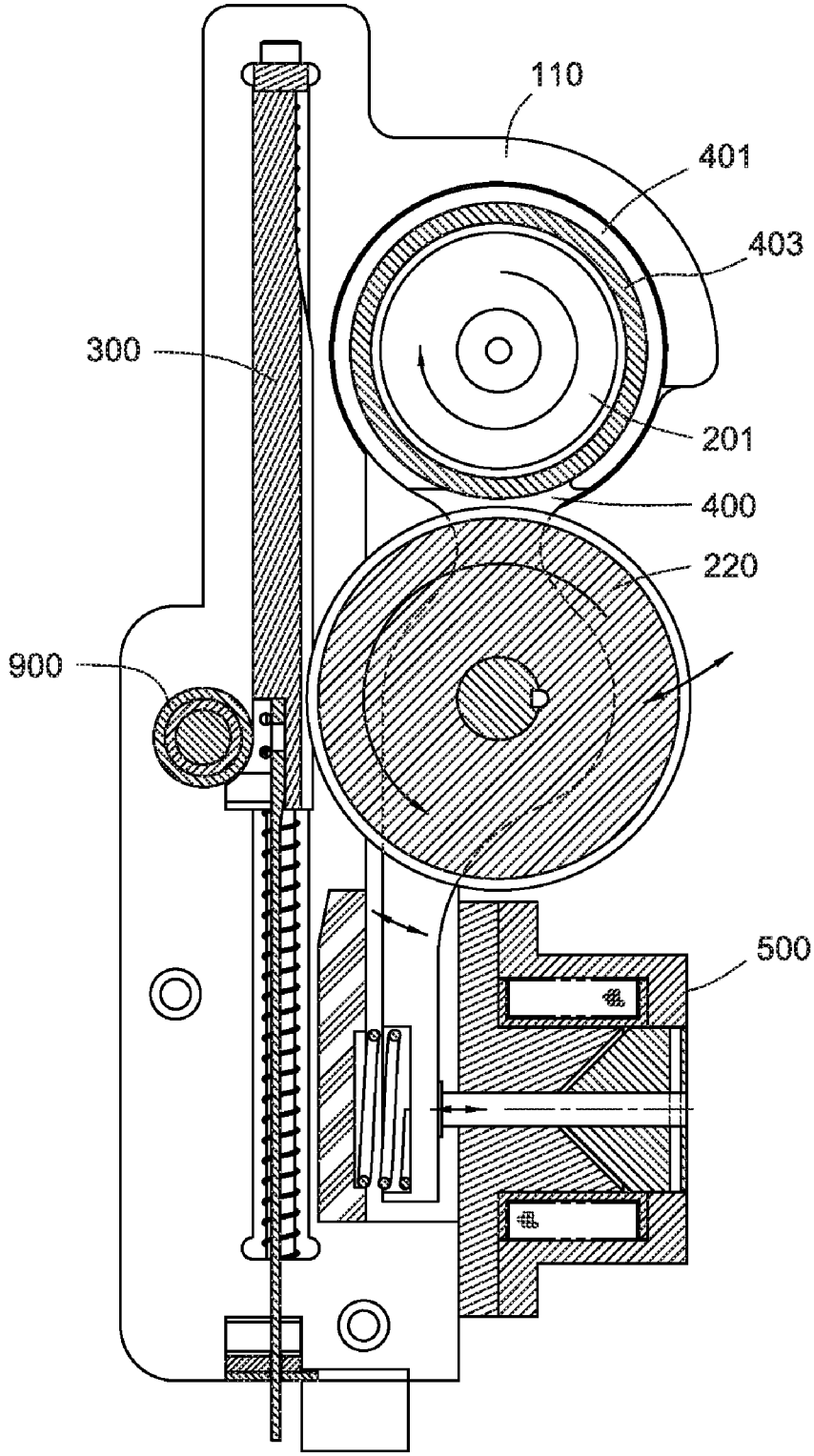
FIG. 12 is a side cross sectional view of FIG. 11 in a working status.

Referring to FIGS. 9 to 11, FIGS. 9 to 11 show another structure of the driver 5. In greater detail, a ring portion 401 is formed on a swing base 400. A sleeve barrel 403 is received in the ring portion 401, and the ring portion 401 is pivotally mounted on a top end of a supporting bracket 110 via the sleeve barrel 403. Accordingly, the aforementioned post axis 14 is replaced. A receiving room 402 is defined in the sleeve barrel 403 for receiving a motor 201 to provide concentricity for a central axis 202 of the motor 201 and a central axis of the ring portion 401. A flywheel 220 is mounted on the swing base 400, and two belt rollers 203, 223 which are connected via a belt 204, is disposed on the central axes 202, 222 of the motor 201 and the flywheel 220, respectively. Alternatively, a pair of gear wheels meshed each other, is respectively disposed on the central axes 202, 222 of the motor 201 and the flywheel 220. Comparing with the aforementioned structure, the flywheel 220 is adjacent to opposite end sides of a sliding base 300 and a free roller 900 (as shown in FIG. 12). As such, the flywheel 220 can be driven by the motor 201 to rotate, and an electric driver 500 can control engagement or disengagement of the flywheel 220 on the swing base 400 with/from the sliding base 300.

To sum up, the present invention has sufficiently disclosed necessary technical features which can be employed in industry. Because the flywheel directly meshes with the sliding base to thereby driving the hitting nail bar on the sliding base to move downwards to hit the nail, it is a advantageous to improve durability of the electrical nail gun. In addition, the free roller is positioned in the housing. When the driver swings to the first position to cause engagement the flywheel with the sliding base, the flywheel exerts a push force on the sliding base, and the push force can be counteracted because of resistance of the free roller to cause stable engagement or disengagement of the driving wheel with/from the flywheel, thereby stably hitting the nail. Thus, it is a advantageous to improve operation stability of the electrical nail gun.

While the present invention has been illustrated by the description of preferred embodiments thereof, and while the preferred embodiments have been described in considerable detail, it is not intended to restrict or in any way limit the scope of the appended claims to such details. Additional advantages and modifications within the spirit and scope of the present invention will readily appear to those skilled in the art. Therefore, the present invention is not limited to the specific details and illustrative examples shown and described.

What is claimed is:

1. A clutch mechanism arranged in a housing of an electrical nail gun comprising:

a sliding base slidably disposed on an end of a free roller positioned in the housing, the sliding base loading a spring and forming a hitting nail bar thereon;

a driver driven by electricity, the driver having a motor and a flywheel driven by the motor, the flywheel being configured to engage or disengage with/from the sliding base;

a swing base pivotally mounted on the housing, the swing base being adjacent to the sliding base and the free roller and receiving the driver therein; and an electric driver attached to the housing and being adjacent to an end side of the swing base, the electric driver having a rod member driven by electricity, wherein the rod member drives the swing base to swing to a first position where the flywheel meshes with the sliding base to thereby drive the sliding base to move downwards, and a second position where the flywheel disengages from the sliding base to thereby cause the sliding base to reposit.

2. The clutch mechanism as described in claim 1, wherein at least one extension spring is disposed on the sliding base, the at least one extension spring connects a positioning post in the housing with the sliding base.

3. The clutch mechanism as described in claim 1, wherein the sliding base is fixedly mounted on a sliding table which is slidably mounted on at least one guiding post in the housing, and a compression spring is displaced around the at least one guiding post for resisting against the sliding table to thereby load the compression spring on the sliding base.

4. The clutch mechanism as described in claim 1, wherein a side surface of the sliding base defines a plurality of linear grooves therein, and the flywheel defines a plurality of ring-shaped or sector-shaped grooves therein for mesh with the linear grooves of the sliding base.

5. The clutch mechanism as described in claim 1, wherein the swing base is rotatably mounted on a post axis in the housing, and the flywheel is adjacent to end sides of the sliding base and the free roller.

6. The clutch mechanism as described in claim 5, wherein the swing base is formed to have an arm portion thereon.

7. The clutch mechanism as described in claim 6, wherein an extension plate extends out from the swing base, and the rod member pushes the extension to thereby drive the swing base to swing from the second position to the first position.

8. The clutch mechanism as described in claim 1, wherein the flywheel is securely mounted on a central axis of the motor for being driven by the motor.

9. The clutch mechanism as described in claim 1, wherein the motor is disposed on a side of the flywheel for driving the flywheel to rotate.

10. The clutch mechanism as described in claim 9, wherein the swing base is formed to have a ring portion thereon for receiving the motor therein, and the flywheel is disposed on the swing base and adjacent to opposite end sides of the sliding base and the free roller.

11. The clutch mechanism as described in claim 10, wherein the swing base is formed to have an arm portion thereon.

12. The clutch mechanism as described in claim 11, wherein an extension plate extends out from the swing base, and the rod member pushes the extension to thereby drive the swing base to swing from the second position to the first position.

13. The clutch mechanism as described in claim 1, wherein the swing base is formed to have an arm portion thereon.

14. The clutch mechanism as described in claim 1, wherein the electric driver is an electro-magnetic driver.

15. The clutch mechanism as described in claim 1, wherein an extension plate extends out from the swing base, and the rod member pushes the extension to thereby drive the swing base to swing from the second position to the first position.

16. The clutch mechanism as described in claim 15, wherein an elastic member is disposed between the extension plate and an end wall of the housing for driving the swing base to swing from the first position to the second position.

17. The clutch mechanism as described in claim 15, wherein the rod member is connected to the extension plate for driving the swing base to swing between the first position and the second position.

* * * * *